United States Patent [19]

Hurko et al.

[11] 4,009,795

[45] Mar. 1, 1977

[54] COMBINED REFLECTOR PAN AND TRIM RING

[75] Inventors: Bohdan Hurko; Raymond L. Dills, both of Louisville, Ky.

[73] Assignee: General Electric Company, Louisville, Ky.

[22] Filed: Dec. 8, 1975

[21] Appl. No.: 638,896

[52] U.S. Cl. ..... 220/64; 219/461

[51] Int. Cl.[2] ..... B65D 25/14

[58] Field of Search ..... 219/347, 405, 438, 439, 219/460, 461, 462, 463, 464; 126/39 J, 214 A, 274; 206/56, 448, 518, 820; 220/84, 64; 99/400; 240/103

[56] References Cited

UNITED STATES PATENTS

| | | | |
|---|---|---|---|
| 2,264,270 | 12/1941 | Barnsteiner | 219/461 X |
| 3,051,818 | 8/1962 | Prather | 219/463 |
| 3,130,664 | 4/1964 | Jarmuth et al. | 219/463 X |
| 3,162,201 | 1/1965 | Woodman | 206/448 |
| 3,227,856 | 1/1966 | Hurko et al. | 219/463 |
| 3,319,062 | 5/1967 | Falk | 240/103 |
| 3,527,154 | 9/1970 | Shaper | 99/400 |
| 3,788,513 | 1/1974 | Racz | 220/64 |
| 3,816,704 | 6/1974 | Borom et al. | 219/462 |
| 3,909,591 | 9/1975 | Ulam | 219/438 |
| 3,927,658 | 12/1975 | Olthuis | 126/214 A |

FOREIGN PATENTS OR APPLICATIONS

| | | | |
|---|---|---|---|
| 1,035,718 | 4/1953 | France | 219/461 |
| 982,308 | 11/1961 | United Kingdom | 219/461 |

*Primary Examiner*—Volodymyr Y. Mayewsky
*Attorney, Agent, or Firm*—Richard L. Caslin; Francis H. Boos

[57] ABSTRACT

An electric range for household cooking purposes has a cooktop with a plurality of surface heating units in the form of coils of metal-sheathed, electrical resistance heating elements. Each unit is mounted in an opening in the cooktop. A combined reflector pan and trim ring is interposed in the opening for supporting the unit, for radiating the heating energy in an upward direction and for collecting spillage. The combined pan and trim ring is manufactured of the optimum materials so it will perform its functions, and, moreover, may be cleaned in a pyrolytic self-cleaning oven without injury or discoloration.

2 Claims, 5 Drawing Figures

COMBINED REFLECTOR PAN AND TRIM RING

BACKGROUND OF THE INVENTION

1. Field of the Invention

This invention relates to surface heating means for cooking purposes, and particularly to a combined reflector pan and trim ring that supports the heating unit.

2. Description of the Prior Art

In the past, most if not all reflector pans were separate from the decorative trim ring which surrounds the heating unit. Most trim rings are made integral with the heating unit as is shown in the Dills U.S. Pat. No. 3,258,580. Some trim rings are made independent of both the heating unit and the reflector pan. All trim rings are made with a highly reflective surface such as chromium plating to present a decorative appearance. Most reflector pans are made with highly reflective surface to direct the heat energy in an upwardly direction for improved heat transfer efficiency with respect to a utensil supported on the heating unit. It is well to maintain both the reflector pan and the trim ring clean of food soil for both appearance and operational purposes.

Many electric ranges are furnished with pyrolytic self-cleaning ovens which utilize a high temperature cycle between about 750° F. and 950° F. for an extended period of time for automatically decomposing the food soil and grease spatter lodged on the walls of the oven liner and the oven door. It is advantageous to be able to clean the reflector pans and trim rings in the self-cleaning oven.

Aluminum reflector pans have been widely used and later cleaned in a self-cleaning oven. One disadvantage is that the aluminum tends to soften at heat cleaning temperatures. It is important not to place anything on top of an inverted reflector pan during the pyrolytic cleaning cycle in order to prevent distortion of the pan once the aluminum softens during cleaning. After a few cleaning cycles, an aluminum pan loses its strength completely and it can be distorted even when handling very carefully.

Chromium plated reflector pans and trim rings cannot be cleaned in a self-cleaning oven because they cannot withstand the high temperatures without discoloring badly.

Porcelain enamelled steel reflector pans have been used with surface heating units and cleaned in self-cleaning ovens but there still remains the problem with cleaning and discoloration of the trim rings, and reflecting the heat energy in an upward direction.

The principal object of the present invention is to provide a combined reflector pan and trim ring of sheet material which will not deteriorate when subjected to the temperatures encountered in a pyrolytic self-cleaning oven.

A further object of the present invention is to provide a combined reflector pan and trim ring of the class described formed of composite sheet material with an aluminum top layer reinforced steel layer that is corrosion resistant.

A further object of the present invention is to provide a combined reflector pan and trim ring of the class described of corrosion resistant steel which supports and reinforces an integral aluminum trim ring.

SUMMARY OF THE INVENTION

The present invention, in accordance with one form thereof, relates to a combined reflector pan and trim ring for use with a surface heating unit in the form of a steel bowl with an outwardly extending flange along its top edge. The steel bowl has a corrosion resisting surface, and at least the top surface of the flange is provided with a layer of aluminum that serves as a decorative trim ring for a surface heating unit.

BRIEF DESCRIPTION OF THE DRAWINGS

This description will be better understood from the following description taken in conjunction with the accompanying drawings and its scope will be pointed out in the appended claims.

DESCRIPTION OF THE PREFERRED EMBODIMENTS

Figure 1:
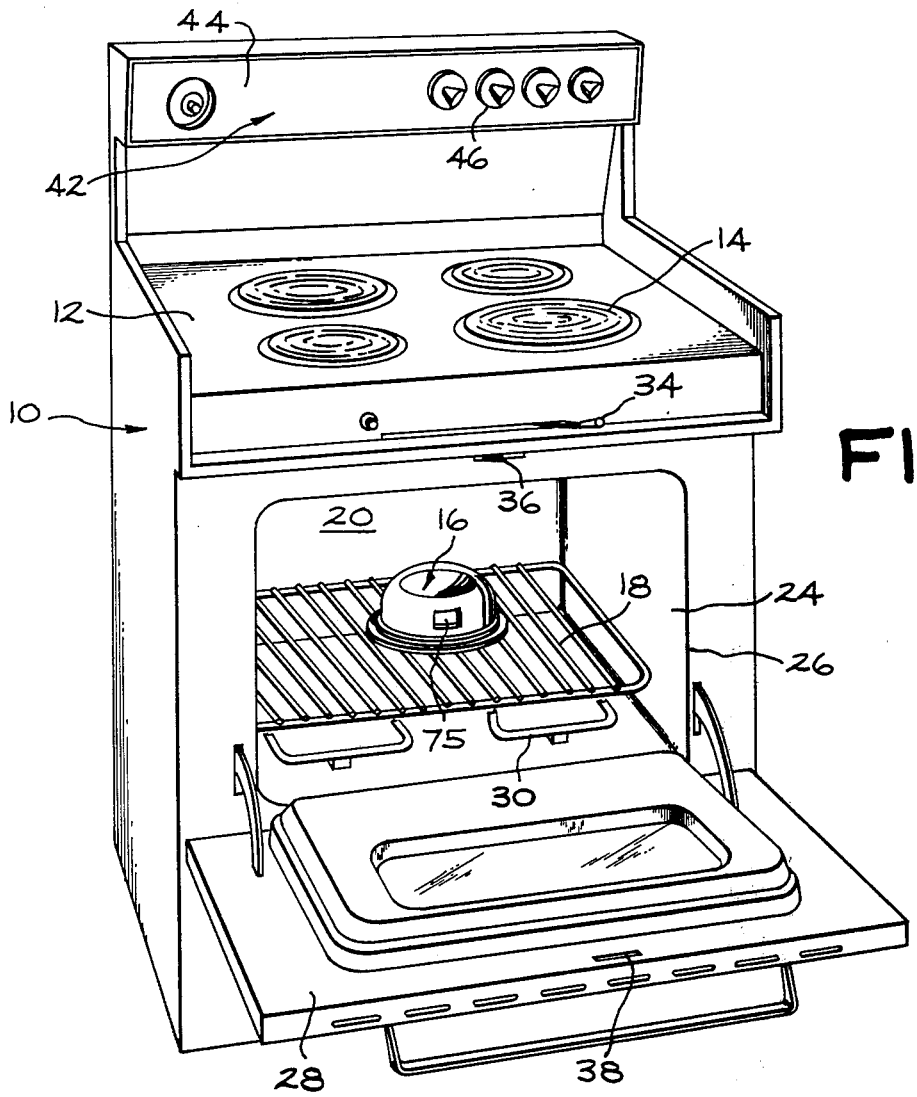
FIG. 1 is a showing of a free-standing electric range having a cooktop with a plurality of surface heating units which are each furnished with the combined reflector pan and trim ring of the present invention. The oven door is shown in the open position to illustrate a complete reflector pan and trim ring assembly in an inverted position on the oven rack for automatic cleaning during a pyrolytic self-cleaning cycle.
Figure 2:
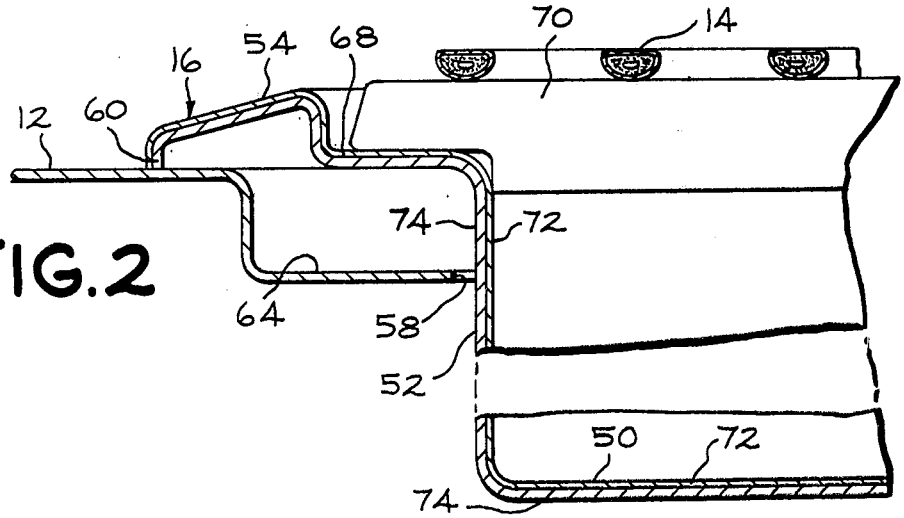
FIG. 2 is a fragmentary cross-sectional elevational view on an enlarged scale through one side of a surface heating unit of FIG. 1 showing the nature of the preferred embodiment of the combined reflector pan and trim ring of the present invention made of composite sheet material of aluminum top layer and a bottom layer of either stainless steel or aluminized steel.

Turning now to a consideration of the drawings, and in particular to FIG. 1, there is shown for illustrative purposes a free-standing electric range 10 having a top cooking surface 12 furnished with a plurality of surface heating units 14. As is standard in this art, such heating units are coils of metal-sheathed, electrical resistance heating elements, as is shown in U.S. Pat. No. 3,767,897 of Richard V. Prucha and Teamus Bowling, which is also assigned to the present assignee. Located beneath each heating unit 14 is a combined reflector pan and trim ring assembly 16, one modification of which is shown in FIG. 2. One of these reflector pan and trim ring assemblies 16 is shown in an inverted position on an oven rack 18 within the oven cooking cavity 20 that is located beneath the cooktop 12. This oven cooking cavity 20 is formed by a box-like oven liner 24 that is provided with a front opening 26 that is adapted to be closed by a drop-down oven door 28. A lower BAKE heating element 30 is shown adjacent the bottom wall of the oven liner.

This particular oven is a baking and broiling oven that has a pyrolytic self-cleaning oven cycle designed according to the teachings of U.S. Pat. No. 3,121,158 of Bohdan Hurko. This can be ascertained by the presence of the oven door latch handle 34 located along the front edge of the cooktop 12. The oven door must be locked at temperatures above about 600° F. The door latch mechanism includes a hook member 36 in the front frame of the oven, and a keeper slot 38 formed on the inner surface of the oven door 28.

A backsplash 42 rises from the cooktop 12 along the back edge thereof, and it contains a front control panel 44 that supports a plurality of conventional control components 46 for both the surface heating units 14 as well as the oven BAKE heating element 30 and additional oven elements and accessories that are not shown, as they form no part of the present invention.

FIG. 2 is a fragmentary view of one side of a surface heating unit 14 supported on the preferred embodiment of a combined reflector pan and trim ring 16 of the present invention. The combined reflector pan and trim ring assembly 16 is in the form of a bowl-shaped container with an imperforate bottom wall 50 and generally vertical side walls 52 that terminate in an outwardly extending flange 54. The cooktop 12 is formed with a recessed opening 58 that is slightly larger than the size of the bowl so the combined assembly 16 may be centered within the opening 58. The peripheral flange 54 is slightly inclined downwardly and it has a slight vertical rim 60. The recessed opening 58 in the cooktop 12 is created by forming a recessed peripheral ledge 64 in the area of the cooktop surrounding the opening 58. Moreover, the innermost portion of the outwardly extending flange 54 is formed with a recessed peripheral ledge 68 so as to serve as the supporting means for the spider 70 on which the heating element 14 is seated. The spider 70 is made up of a series of radial arms or straps that are arranged to have minimum edgewise contact with the heating element 14, as is shown for example in both the Dills U.S. Pat. No. 3,258,580 and the Prucha/Bowling U.S. Pat. No. 3,767,897, cited above.

The combined reflector pan and trim ring 16 of the preferred embodiment of FIG. 2 is formed of thin composite sheet material having a top layer of aluminum 72 and a bottom layer of corrosion resistant steel such as stainless steel or aluminized steel 74. This resulting structure is strong at self-cleaning temperatures which rise into an oven air temperature range approaching 950° F. The aluminum layer 72 can not buckle because it is reinforced by the steel underlayer 74. Moreover, this assembly is thermally more efficient for two reasons. First, this assembly will reflect more heat in an upwardly direction because the usual large opening in the bottom wall of the reflector pan has been eliminated. Secondly, since this assembly can be cleaned automatically within the oven without manual scrubbing, it would be maintained in a cleaner, reflective condition free of a buildup of grease and cooking spillage than the present reflector pans.

In the prior art, most of the reflector pans have been provided with a large bottom opening to allow for drainage into the rough-in box below and prevent a buildup of grease in the pan that might otherwise create a safety hazard. Hence, with the use of the combined reflector pan and trim ring assembly of the present invention, it will not be necessary to periodically clean out the rough-in box (not shown) beneath the cooktop 12 of grease and cooking liquid drainage. As seen in FIG. 1, the assembly 16 has a relatively small side opening 75 so the electrical terminals of the heating element 14 may be plugged into a terminal block located beneath the cooktop as generally taught in the above-cited Prucha/Bowling U.S. Pat. No. 3,767,897. This opening 75 is of minimum size in this invention so as not to reduce the reflective capability of the reflector pan.

Also, with the reflector pan maintained clean and reflective without much effort, the heating elements will operate more efficiently during their operating lifetime. This results in an energy saving, especially when cooking utensils with warped bottoms are used. The heater coils will produce a high percentage of radiant heat which will be reflected toward the utensil bottom.

Figure 3:
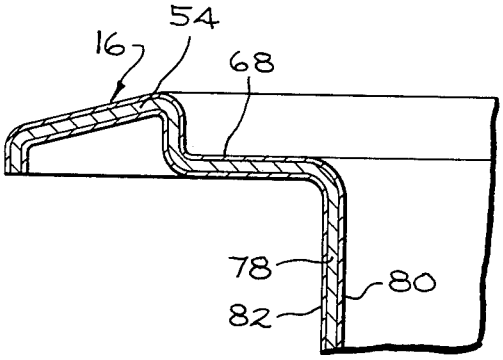
FIG. 3 is a second modification of the combined reflector pan and trim ring of the present invention of composite sheet material with a steel core and outer skins of aluminum.

Another modification of the present invention is shown in FIG. 3. The combined reflector pan and trim ring assembly 16 is of the same overall configuration as in FIG. 2, except it is formed of a three-ply composite sheet material having a center core 78 of high mechanical and thermal strength such as stainless steel or low-carbon steel and an upper and lower skin of aluminum 80 and 82, respectively, where the aluminum skin has high thermal reflectivity and resistance to discoloration at temperatures near 950° F.

Figure 4:
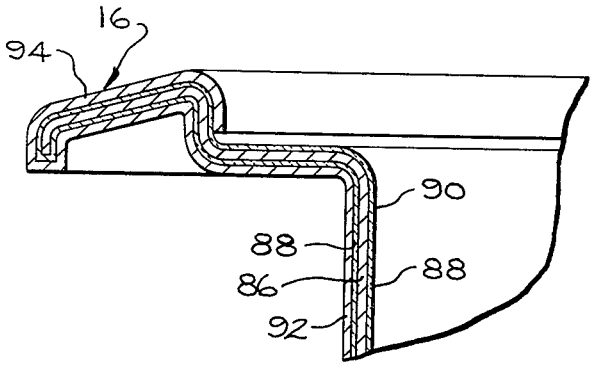
FIG. 4 is a third modification of the combined reflector pan and trim ring of the present invention of porcelain enamelled steel with a catalytic coating on the inner side, a deposited reflective coating on the outermost side, and an aluminum trim ring made integral with the outwardly extending flange formed on the top edge of the reflector pan.

A third modification of the present invention is shown in FIG. 4. The combined reflector pan and trim ring assembly 16 is formed of sheet steel. First, it is deep drawn into the required shape, then it is coated top and bottom with a procelain enamel finish 88, then a porous catalytic finish 90 is applied to the top side of the assembly 16. This porous finish 90 causes decomposition of food soil at much lower temperatures than pyrolytic cleaning, and it is widely used in ovens and sold under the trade designation — "continuous cleaning." See the Stiles U.S. Pat. No. 3,266,477. Finally, a reflective coating 92, such as aluminum, is deposited on the underside of the assembly 16, and a separate aluminum trim ring 94 is press-fitted over the flange 54, and hence permanently attached thereto.

Figure 5:
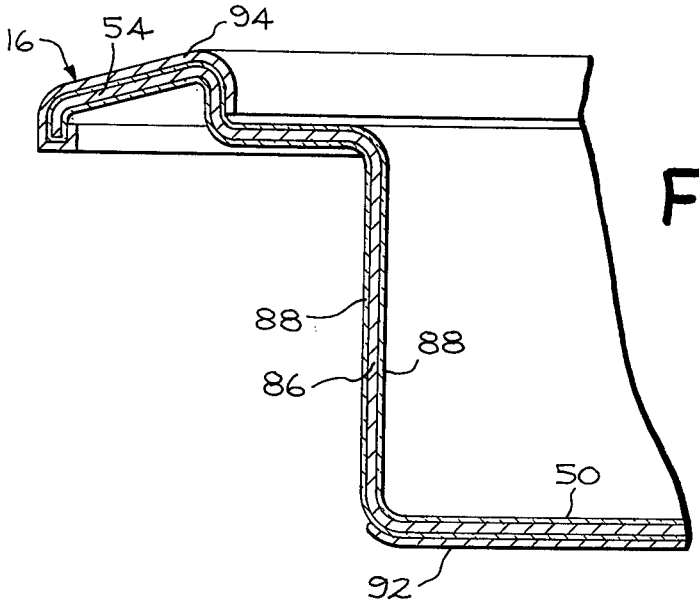
FIG. 5 is a fourth modfication of the combined reflector pan and trim ring of the present invention, similar to that of FIG. 4, but with the reflective coating formed only on the underside of the bottom wall of the reflector pan.

A fourth modification of the present invention is shown in FIG. 5. The combined reflector pan and trim ring assembly 16 is again formed of sheet steel 86 with an overall coat of procelain enamel 88. The inner side may or may not have a porous catalytic finish applied thereto. There is, however, a reflective coating 92, such as aluminum, applied across the bottom wall 50 of the reflector pan. Also, the flange 54 is fitted with the aluminum trim strip 94, the same as the third modification of FIG. 4.

It will be understood by those skilled in this art that the first two modifications of this invention of FIGS. 2 and 3 are much more efficient than the last two modifications of FIGS. 4 and 5, because the first two modifications employ composite sheet material with an upper reflective layer of aluminum which is much better as a reflective surface than the porcelain enamelled pans of the last two modifications of FIGS. 4 and 5. However, the last two modifications will withstand the high temperatures and they do employ a decorative, reflective trim ring that is integral with the reflector pan.

Modifications of this invention will occur to those skilled in this art; therefore, it is to be understood that this invention is not limited to the particular embodiments disclosed but that it is intended to cover all modifications which are within the true spirit and scope of this invention as claimed.

We claim:

1. A combined reflector pan and trim ring for use in supporting an electric surface heating unit, said pan comprising a bowl-shaped container formed of composite sheet material having an upper layer of aluminum and a lower layer of steel selected from the group of materials comprising stainless steel and aluminized steel, said container having an outwardly extending flange adjacent its top edge to serve as a decorative trim ring for encircling the surface heating unit, said upper aluminum layer being of high reflectivity and high resistance to discoloration at high temperatures above about 750° F.

2. A combined reflector pan and trim ring as recited in claim 1 wherein the composite sheet material also has a layer of aluminum, beneath the steel layer.

* * * * *